US007530440B2

(12) United States Patent
Nagano

(10) Patent No.: US 7,530,440 B2
(45) Date of Patent: May 12, 2009

(54) GAMING MACHINE

(75) Inventor: Hiroyuki Nagano, Tokyo (JP)

(73) Assignee: Aruze Corp, Tokyo (JP)

( * ) Notice: Subject to any disclaimer, the term of this patent is extended or adjusted under 35 U.S.C. 154(b) by 551 days.

(21) Appl. No.: 10/696,594

(22) Filed: Oct. 30, 2003

(65) Prior Publication Data

US 2004/0134747 A1 Jul. 15, 2004

(30) Foreign Application Priority Data

Oct. 30, 2002 (JP) ..... 2002-316729

(51) Int. Cl.
*G07F 1/04* (2006.01)

(52) U.S. Cl. ..... 194/347

(58) Field of Classification Search ..... None
See application file for complete search history.

(56) References Cited

U.S. PATENT DOCUMENTS

| | | | | |
|---|---|---|---|---|
| 3,481,464 | A * | 12/1969 | Townsend | 209/534 |
| 5,027,937 | A * | 7/1991 | Parish et al. | 194/348 |
| 5,156,250 | A * | 10/1992 | Parish et al. | 194/348 |
| 5,505,289 | A * | 4/1996 | Watabe et al. | 194/206 |
| 5,566,809 | A * | 10/1996 | Vogt et al. | 194/348 |
| 5,605,214 | A * | 2/1997 | Yukimoto et al. | 194/348 |
| 5,738,200 | A * | 4/1998 | Bruner | 194/348 |
| 6,279,720 | B1 * | 8/2001 | Delmenico et al. | 194/348 |

FOREIGN PATENT DOCUMENTS

| | | |
|---|---|---|
| JP | 533595 U | 1/1978 |
| JP | 5589170 U | 6/1980 |
| JP | 05-007664 | 1/1993 |
| JP | 06-047161 | 2/1994 |
| JP | 06-047168 | 2/1994 |
| JP | 07-185120 | 7/1995 |
| JP | 07-194837 | 8/1995 |
| JP | 07-311869 | 11/1995 |
| JP | 08-141202 | 5/1996 |
| JP | 09-106471 | 4/1997 |
| JP | 10-216347 | 8/1998 |
| JP | 2001-022997 | 1/2001 |

(Continued)

OTHER PUBLICATIONS

Notice of Reasons for Rejection of Japanese Patent Application No. 2002-316729 mailed Aug. 5, 2008.

*Primary Examiner*—Ronald Laneau
*Assistant Examiner*—Tramar Harper
(74) *Attorney, Agent, or Firm*—Lowe Hauptman Ham & Berner, LLP

(57) ABSTRACT

A gaming machine is provided with a cabinet; a door (3), provided on the front face of the above-mentioned cabinet; a bill insertion slot (529), provided on the door (3); and a bill guide plate (52A), which extends outwards from the lower end of the bill insertion slot (529) and is for guiding a bill into the bill insertion slot (529). The bill guide plate (52A) has a plurality of substantially rectilinear slit openings (521) formed in rows. Even when a drink or other foreign matter is spilled onto the bill guide plate (52A), it can be prevented from getting on the various devices inside the cabinet via the bill insertion slot (529) and thus breakage of the various devices can be prevented.

20 Claims, 6 Drawing Sheets

FOREIGN PATENT DOCUMENTS

| | | |
|---|---|---|
| JP | 2001-149631 | 6/2001 |
| JP | 2001-293224 | 10/2001 |
| JP | 2002-074468 | 3/2002 |
| JP | 2002177445 A | 6/2002 |
| JP | 2003-016495 | 1/2003 |
| JP | 2003-190616 | 7/2003 |
| JP | 2003-305156 | 10/2003 |

* cited by examiner

GAMING MACHINE

CROSS-REFERENCE TO THE RELATED APPLICATIONS

This application is based upon and claims a priority from the prior Japanese Patent Application No. 2002-316729 filed on Oct. 30, 2002, the entire contents of which are incorporated herein by reference.

FIELD OF THE INVENTION

The present invention relates to a gaming machine.

RELATED ART

Video poker machines, slot machines, and other gaming machines are installed in casinos, etc. Those are equipped with a bill insertion slot for directly inserting bills instead of coins or medals. An example is disclosed in Japanese Unexamined Patent Publication No. 09-106471.

With such a gaming machine, when a player runs out of coins, etc., on hand, the player will not have to stand up from his/her seat and go to a coin changer to change bills into coins, etc. The player can also continue to play a game without having to call game-hall staff.

In many cases, at a lower position of such a bill insertion slot, a bill guide plate for guiding a bill into the bill insertion slot is provided. By providing such a bill guide plate, a player can insert a bill into the bill insertion slot more readily.

However, in a game arcade, there are people who play games while taking a simple meal or drink and a drink may become spilled onto the bill guide plate by chance. There are also insolent persons who, on becoming irritated of not obtaining the desired game results, throws a drink in his/her hand onto the gaming machine.

The bill guide plate has an upper surface that is relatively large in area and thus has a structure that may receive a spilled drink or other foreign matter more readily in comparison to other parts of the gaming machine in the above circumstances. Furthermore, since the bill guide plate is disposed adjacent the bill insertion slot, the above-mentioned foreign matter may enter inside the bill insertion slot.

Since the entry of such foreign matter into the bill insertion slot leads to malfunction of the gaming machine, such a situation had to be prevented in advance.

A gaming machine which has a bill guide plate with a drain hole has been considered for such a drawback. However, since the drain hole of this gaming machine is small, it tended to clog readily. Also, since the collected liquid was simply drained into a space opened below a cabinet, when a large amount of liquid is spilled, contamination of the interior of the cabinet occurred due to the inadequate draining ability.

The present invention has been made in view of the foregoing. An object of the present invention is to provide a gaming machine, with which even when foreign matter is spilled onto a bill guide plate, the foreign matter can be collected without getting on various devices inside a cabinet.

SUMMARY OF THE INVENTION

The present invention provides a gaming machine, wherein a bill guide plate has a plurality of slit openings of substantially rectilinear form and by which liquid or other foreign matter spilled onto the bill guide plate can be collected via the slit openings.

More specifically, the present invention provides the following.

(1) A gaming machine which enables inserting a bill, the gaming machine comprising: a cabinet; a door, provided on a front face of the cabinet; a bill insertion slot, provided in the door; and a bill guide plate, provided on the door, extending outwards from a lower end of the bill insertion slot, and guiding a bill into the bill insertion slot, wherein the bill guide plate is equipped with a plurality of openings for separating foreign matter from the bill and dropping the foreign matter.

With the above-described aspect of the invention of (1), the bill guide plate, which extends outwards from the lower end of the bill insertion slot and guides a bill into the above-mentioned bill insertion slot, is equipped with a plurality of openings for separating objects besides a bill from the bill and causing such objects to drop. Thus even when a drink or other foreign matter is spilled onto the bill guide plate, it is collected through the openings. The foreign matter will therefore not get on the various devices inside the cabinet.

With those in the related art, when liquid or other foreign matter was spilled onto the bill guide plate, the foreign matter flowed into the bill insertion slot, causing malfunction of the various devices in the interior.

By providing a plurality of openings on the bill guide plate as in the present invention, inflow of the foreign matter via the bill insertion slot can be prevented and breakage of the various devices can thus be prevented.

Also, since a wide opening area due to a plurality of openings is provided in comparison to a case where just a drain hole is provided, even a large amount of liquid can be drained at once. Also, in the case of waste matter of a small amount, clogging due to such waste matter can be prevented.

Also, even when foreign matter, such as tobacco ash, is fallen onto the bill guide plate, the foreign matter can be washed off and thus cleaned off more readily than by wiping off.

(2) The gaming machine according to (1), wherein the plurality of openings are a plurality of slit openings of a substantially rectilinear formation that are disposed parallel to each other.

With the above-described aspect of the invention of (2), the plurality of openings are a plurality of slit openings of substantially rectilinear form that are disposed parallel to each other. Thus even when a drink or other foreign matter is spilled onto the bill guide plate, the foreign matter can be collected rapidly through the plurality of slit openings. And the foreign matter can be prevented from entering via the bill insertion slot and getting on the various devices inside the cabinet.

Also, in comparison to a case where just a drain hole is provided, a plurality of slit openings of substantially rectilinear form are disposed parallel to each other. Thus even a large amount of liquid can be drained at once and clogging due to a small amount of waste matter can be prevented.

Also, even when foreign matter, such as tobacco ash, is fallen onto the bill guide plate, the foreign matter can be washed off and thus cleaned off more readily than by wiping off.

Furthermore, since the design of the slit openings are superior to just a drain hole, design of the cabinet can be done without harming entire design.

(3) The gaming machine according to (1) or (2), wherein the bill guide plate has a plurality of partition members, each of which partition the slot openings, and the partition members form small slit openings.

With the above-described aspect of the invention of (3), a relatively large foreign matter can be prevented from falling through the slit openings. Clogging of an internal part due to a large foreign matter, that is, for example, clogging of a foreign matter guiding part, which is provided in the interior, can thus be prevented.

(4) The gaming machine according to (3), wherein a length of each of the small slit openings formed by the partition members is smaller than a diameter of a coin utilized in the gaming machine.

With the above-described aspect of the invention of (3), the length of each opening of the small slit openings is smaller than the diameter of a coin used in the gaming machine. Thus even when a coin used in the gaming machine is dropped onto the bill guide plate by mistake, the coin can be prevented from dropping through the slit openings.

(5) The gaming machine according to any one from (1) to (4), wherein the door has a mounting member, which is mounted in a detachable manner, and the mounting member has a first opening part, covered by the bill guide plate, and a second opening part, connected to the first opening part and being opened downwards.

With the above-described aspect of the invention of (5), the mounting member, which is a part that contacts foreign matter from the exterior, can be detached readily from the cabinet. Detachment of the mounting member for washing or exchange upon breakage, etc., can thus be performed readily.

(6) The gaming machine according to (5), wherein the above-mentioned bill guide plate is mounted as a separate member onto the above-mentioned mounting member.

With the above-described aspect of the invention of (6), the bill guide plate is mounted as a separate member onto the mounting member. Thus the bill guide plate and the mounting member do not have to be exchanged altogether when either one of them needs to be exchanged due to breakage, soiling, etc.

Other features and advantageous of the invention will be apparent from the following description taken in connection with the accompanying drawings.

PREFERRED EMBODIMENTS OF THE INVENTION

An embodiment of the present invention shall now be described with reference to the drawings. Though an application of the present invention to a slot machine shall be described as the embodiment, the present invention is not limited thereto and may be applied to various other gaming machines, such as video game machines, coin game machines, card game machines, etc.

The construction of a slot machine shall now be described.

Figure 1:
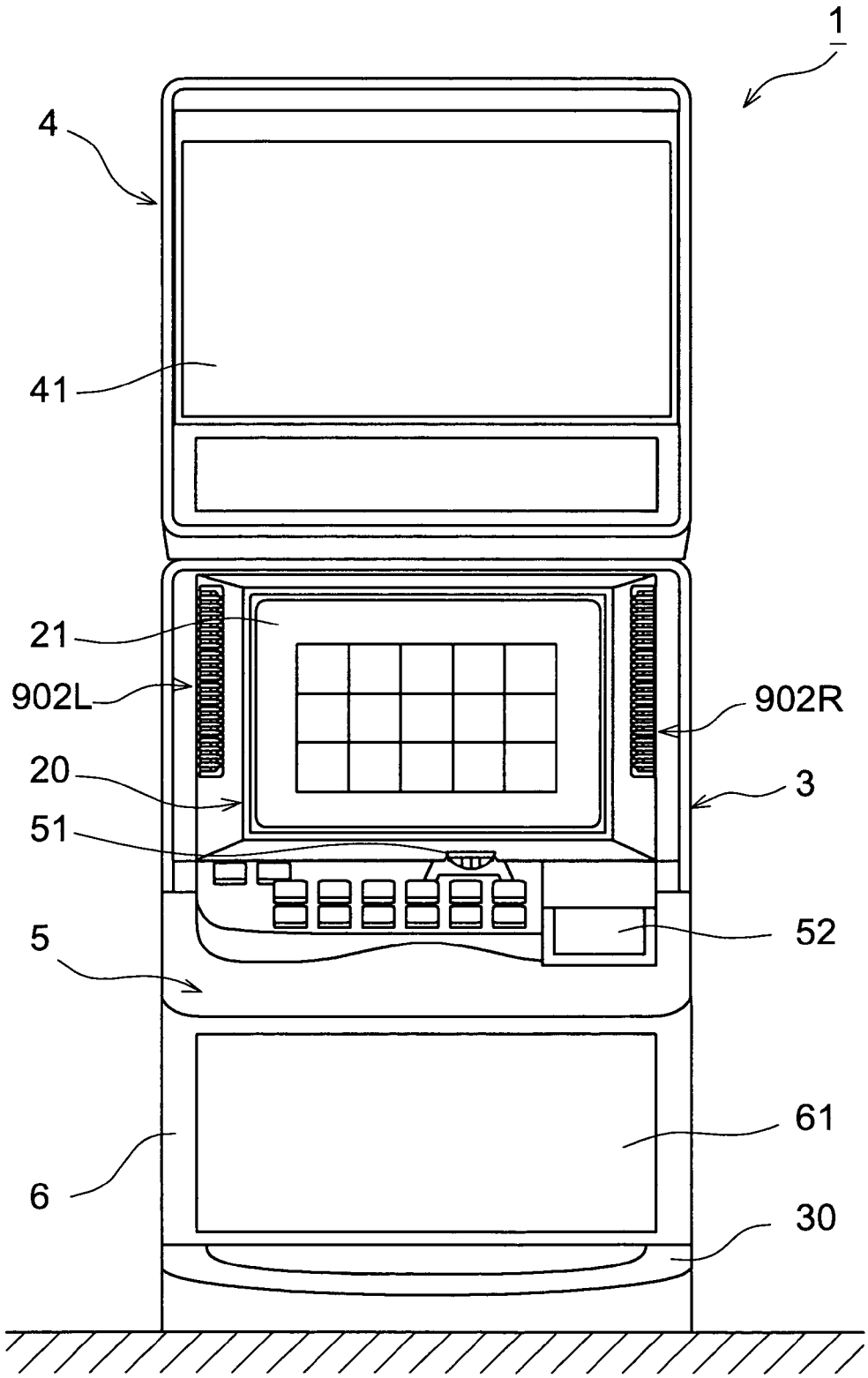
FIG. 1 is a front view of a slot machine of the present invention.

FIG. 1 is a front view of a slot machine 1. At the front opening part of a cabinet 2 of slot machine 1, a door 3 is provided in a manner enabling opening and closing. Also, a top frame 4 is mounted on an upper part of cabinet 2. A decorative panel plate 41 is provided on the front face of top frame 4.

A display device 21, which displays gaming information, is installed inside the cabinet 2. In order to enable viewing of the display on the display device 21, a window is formed on an upper part of the cabinet 3. And in order to enable viewing of the display on the display device 21 and to protect display device 21, a transparent plate is mounted on the above-mentioned window. At both sides of the above-mentioned window are formed sound holes 902 (902L and 902R) that enable effect sounds or music generated according to gaming states to be heard readily.

At a central part of the front face of the door 3, an operating part 5 is disposed in a protruding manner. At an inclined face at the right side of operating part 5, various operation buttons are aligned and a coin slot 51, into which coins are loaded, is equipped. At the right side of the operating part 5 is equipped with a bill loading part 52 for guiding a bill to a bill validator housed inside the cabinet 2.

At a lower part of the operating part 5 is provided a frame 6, which is connected to the door 3 in a manner enabling opening and closing. A decorative panel plate 61 is enclosed in the frame 6. At a lower part of the frame 6 at a bottom part of the door 3 is formed a coin tray 30, which receives coins.

Figure 2:
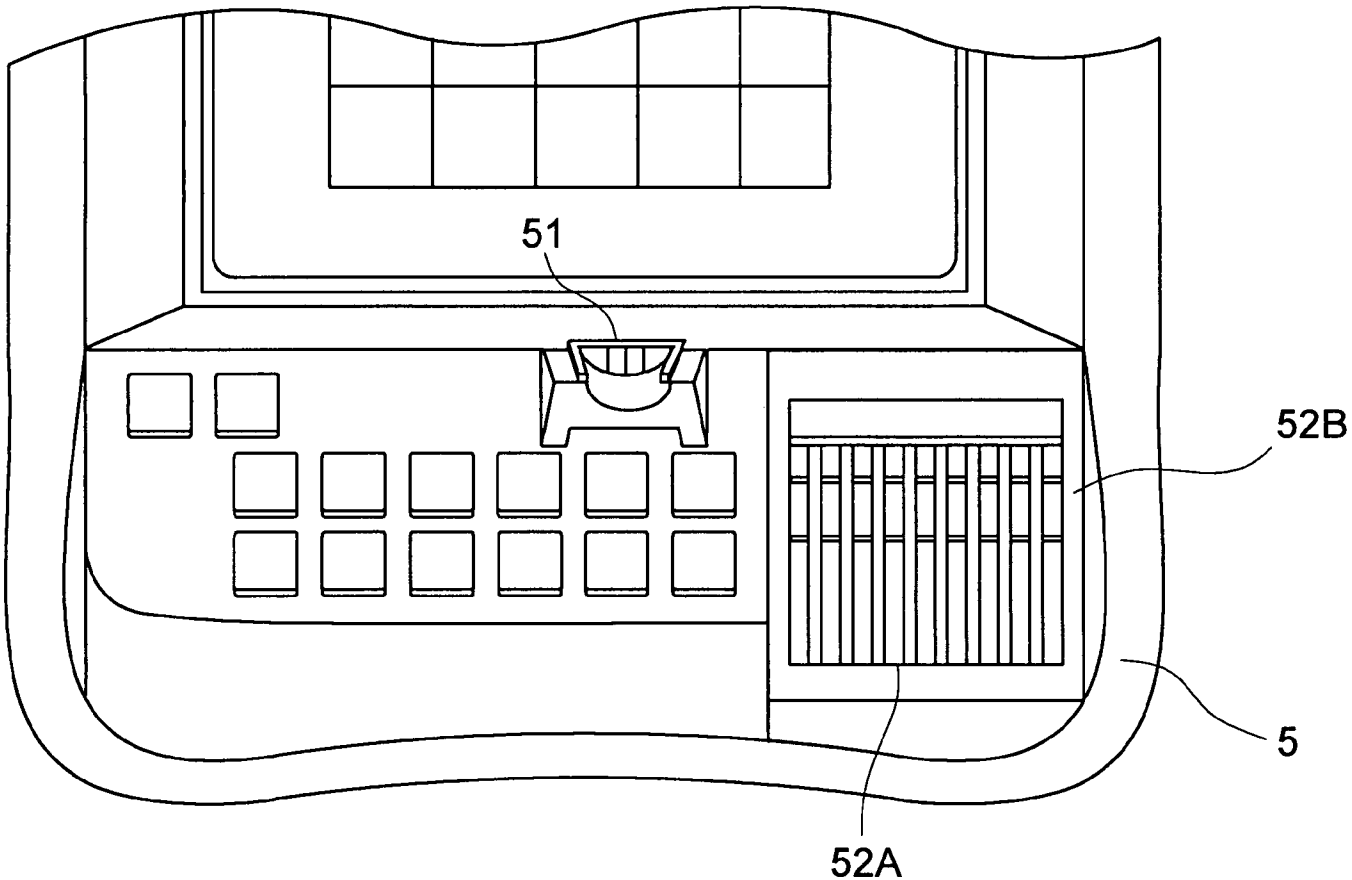
FIG. 2 is a partially enlarged view of an operating part of the present invention.

FIG. 2 is an enlarged view of the operating part 5. The above-mentioned bill loading part 52 comprises a bill guide plate 52A and a mounting member 52B. The bill guide plate 52A and the mounting member 52B are integrated together and mounted to the operating part 5. The mounting member 52B forms a part of the door 3.

Figure 3:
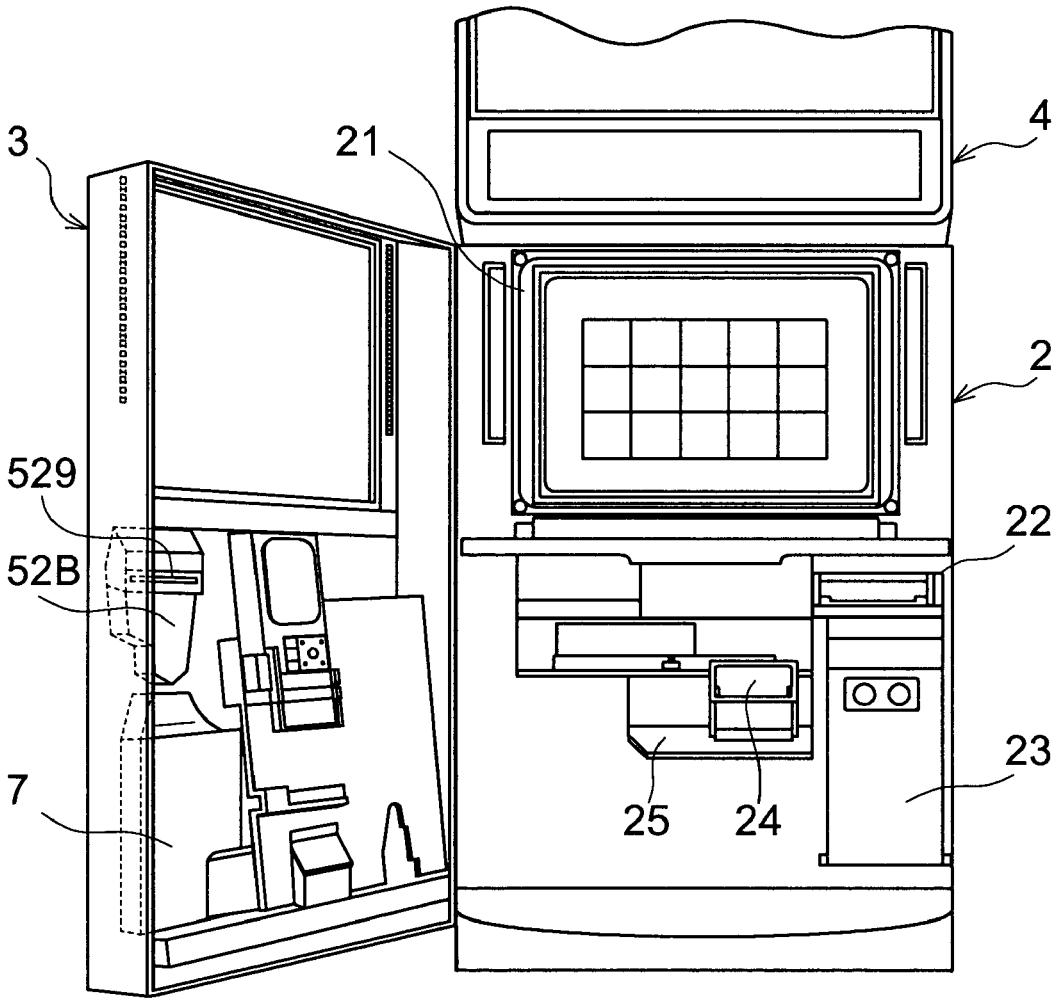
FIG. 3 is a diagram showing a state in which a door of the present invention is opened.

FIG. 3 is a diagram showing a state in which the door 3 is opened. As shown in FIG. 3, the bill validator 22 and a bill stacker 23 are installed inside the cabinet 2. The bill validator 22 determines the truth/falseness or quality of a bill loaded from the bill loading part 52. The bill stacker 23 houses bills validated by the bill validator 22. A bill guided by the bill loading part 52 is taken in by the bill validator 22 via a bill insertion slot 529.

Also, at the rear face side of the door 3, a drain bottle 7, which is a container, is mounted directly below the mounting member 52B.

Figure 4:
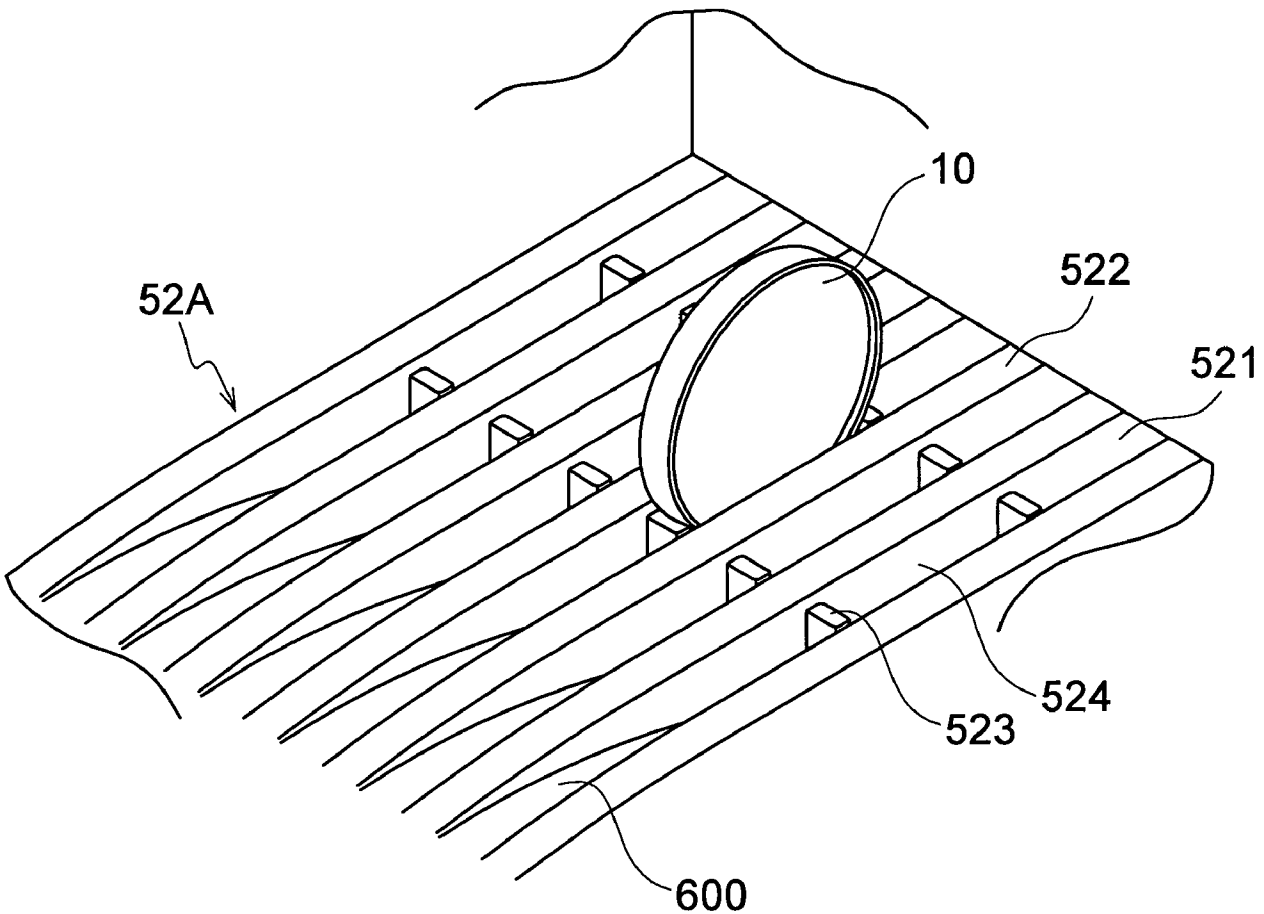
FIG. 4 is a perspective view of a bill guide plate of the present invention.

FIG. 4 is a perspective view of the bill guide plate 52A. As shown in FIG. 4, a plurality of substantially rectilinear slit openings 521 are formed in parallel as a plurality of openings in the bill guide plate 52A.

Slit openings 521 are disposed in parallel with each other. Slit openings 521 run along the direction from the bill insertion slot 529 to the outer side of the cabinet 2. The entirety of the opening of the slit opening 521 does not comprise a hole that passes through bill guide plate 52A. That is, a slit opening 521 is an open groove having a bottom formed by an opening bottom part 600. By providing the bottom at a part of each slit opening, the inner parts of the slit openings and the dropped foreign matter can be prevented from being seen readily by a player while securing an area for taking in foreign matter. Also, partition members 523 are formed on bill guide plate 52A. The partition members 523 partition each slit opening 521 into a plurality of small slit openings 524. The position of the upper surface of a partition member 523 is slightly lower than a bill guide surface 522. And as shown in FIG. 4, the length of each small slit opening 524 partitioned by partition members 523 is formed to be smaller than the diameter of a coin 10 used in the gaming machine.

Figure 5:
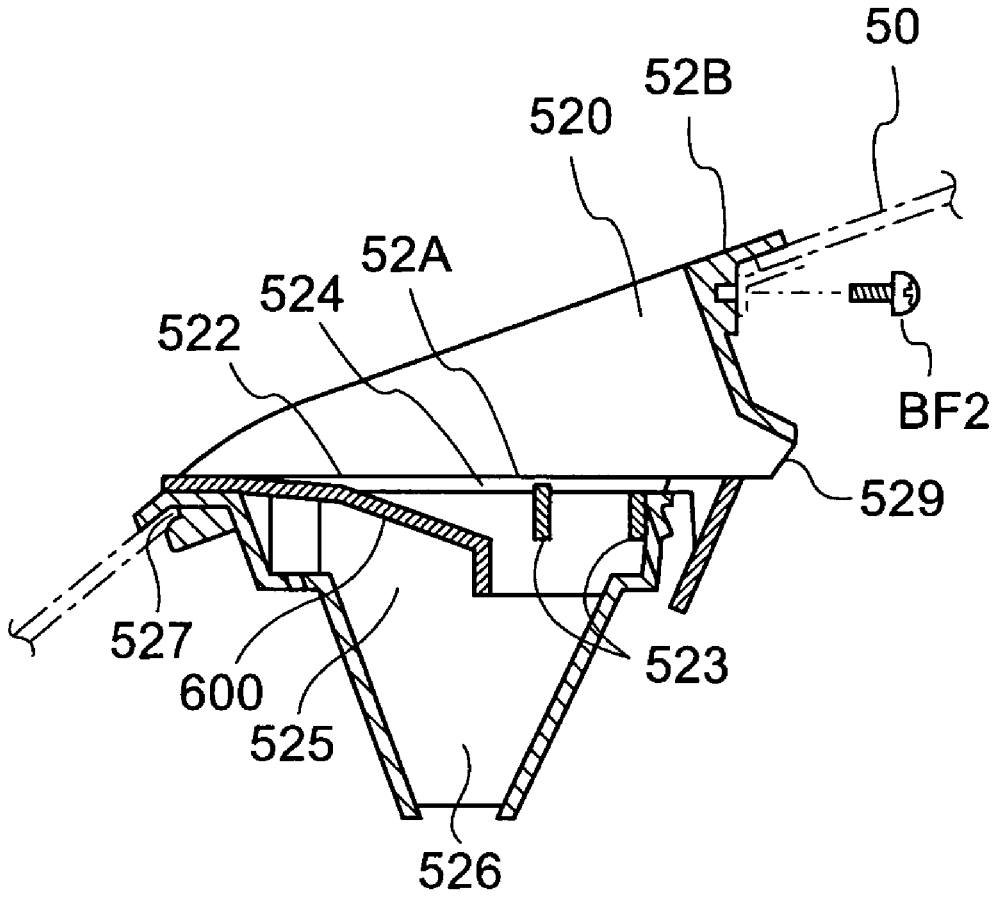
FIG. 5 is a longitudinal sectional view of a state in which the bill guide plate and a mounting member of the present invention are assembled together.

FIG. 5 is a longitudinal sectional view of a state in which the bill guide plate 52A and the mounting member 52B are assembled together. As shown in FIG. 5, the bill guide plate 52A is detachably mounted to a loading slot 520, which serves as a bill insertion space. Also, in order that a bill is taken in readily, the bill guide plate 52A extends outwards from the lower end of the bill insertion slot 529 that is positioned at a lower side of the loading slot 520.

At the mounting member 52B, the peripheral walls that form loading slot 520 are connected to the cabinet 2. The peripheral walls extends downwards and form a first opening 525 that opposes loading slot 520. The peripheral walls that form first opening 525 continue further downward and form a second opening 526 that is open in the downward direction. The loading slot 520, first opening part 525, and second opening part 526 form a space of substantially pyramidal shape with the apex at the lower side. The bill guide plate 52A is formed so as to cover the first opening part 525 from above. The first opening part 525 and second opening part 526 are for guiding liquid and other foreign matter that enter via the slit opening 521 from the exterior.

Figure 6:
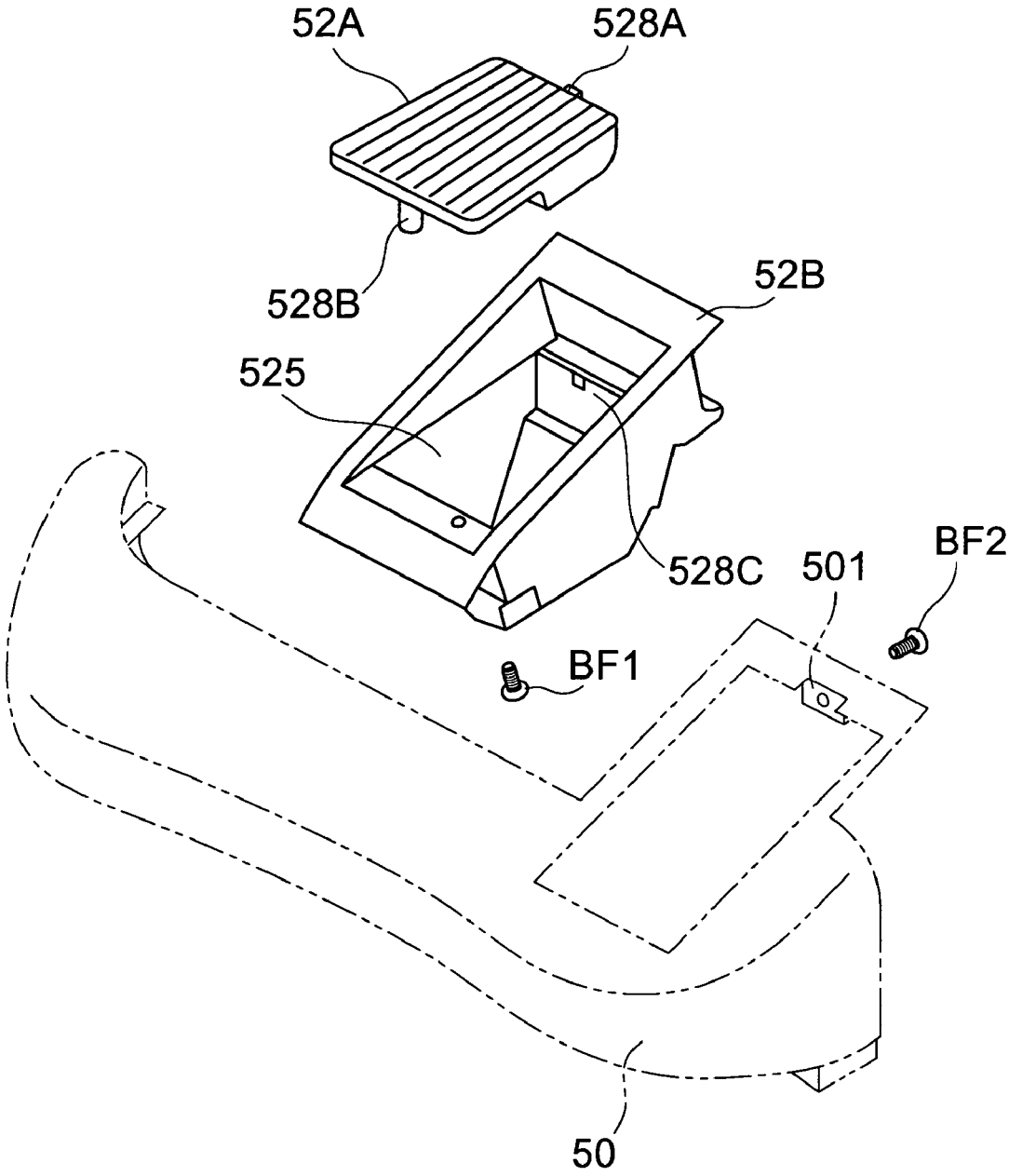
FIG. 6 is an exploded perspective diagram of a bill loading part of the present invention.

FIG. 6 is an exploded perspective diagram of the bill loading part 52. As shown in FIG. 6, a protrusion 528A is formed on the rear wall of the bill guide plate 52A. A cylindrical protrusion 528B is formed on the front lower wall of the bill guide plate 52A. An internal thread is formed in the cylindrical protrusion 528B. Meanwhile, a groove 528C is formed in the rear inner wall of the first opening part 525 of mounting member 52B. The bill guide plate 52A is assembled onto the mounting member 52B by inserting the protrusion 528A of the bill guide plate 52A into the groove 528C and tilting the bill guide plate 52A towards the mounting member 52B. The bill guide plate 52A can also be separated from the mounting member 52B by movement in the opposite direction.

The bill guide plate 52A and mounting member 52B are made integral by fixing the cylindrical protrusion 528B of the bill guide plate 52A to the mounting member 52B utilizing a fixing screw BF1. The integrated bill guide plate 52A and mounting member 52B are then inserted in a notched part of a control panel 50 of the operating part 5. The integrated bill guide plate 52A and mounting member 52B are then fixed by a fixing screw BF2 onto a mounting bracket 501, provided on the control panel 50, thus completing the assembly.

More specifically, as shown in FIG. 5, an edge of the control panel 50 is inserted into a groove 527 formed in a front part of the mounting member 52B and the mounting member 52B is tilted towards control panel 50. And then a collar of the mounting member 52B comes in contact with the upper face of control panel 50. The mounting member 52B is then fixed to the control panel 50 by the fixing screw BF2 to attain the fixed state.

The operation shall now be described. As described in FIG. 4, a plurality of substantially rectilinear slit openings 521 are formed in columns in the bill guide plate 52A. Thus even when a drink or other foreign matter spills onto the bill guide plate, it can be collected through the slit openings 521. The foreign matter will not get on the various devices inside the cabinet and breakage of the various devices can be prevented. Also, though the bill guide plate 52A is made uneven due to slit openings 521, a bill on the bill guide plate 52A can move smoothly since the slit openings 521 are aligned in the direction from the bill insertion slot 529 towards the outer side of the cabinet 2.

Also, when the foreign matter, such as tobacco ash, is fallen onto the bill guide plate, the foreign matter can be washed off and thus cleaned off more readily than by wiping off. Furthermore, in comparison to a case where just a drain hole is provided, the positioning of a plurality of parallel slit openings 521 excels in terms of design.

Furthermore, as shown in FIG. 4, the partition members 523, for partitioning the slit openings 521 into a plurality of small slit openings, are formed on the bill guide plate 52A. The dropping of a relatively large foreign matter through the slit openings is thus prevented, and clogging of an internal part due to such foreign matter. For example, clogging of the second opening part 526, which serves as a foreign-matter-guiding part provided in the interior, can be prevented.

Also, there is a high possibility that the above-mentioned foreign matter is a coin 10. However, as described with FIG. 4, the length of each opening of the small slit openings 524, which are partitioned by the partition member 523, is smaller than the diameter of a coin 10 used in slot machine 1. Thus even if the coin 10 to be used in slot machine 1 is dropped by mistake onto the bill guide plate 52A, the coin will be prevented from dropping through the slit openings 521. With the embodiment, the maximum length of the small slit opening 524 is 18 millimeters. The width of the slit opening 524 is 3.5 millimeters. The coin 10 is 25 millimeters in diameter and approximately 1 mm in width and thus the coin 10 will not fall into the interior.

In order to guide foreign matter from the exterior that has entered via the slit openings 521 of the bill guide plate 52A, the mounting member 52B is provided with the first opening 525, which opposes the loading slot 520, and the second opening 526, which is opened in the downward direction. The bill guide plate 52A is formed so as to cover the first opening 525. By this arrangement, the mounting member 52B, which contacts the foreign matter from the exterior, can be detached readily from the cabinet. It enables easy washing or exchange of the mounting member 52B upon breakage, etc.

Also as described with FIG. 6, the bill guide plate 52A is assembled onto the mounting member 52B by inserting the protrusion 528A of the bill guide plate 52A into the groove 528C of the mounting member 52B and rotating the bill guide plate 52A. The bill guide plate 52A is thus mounted to the mounting member 52B as a separate member. By enabling the bill guide plate to be separated as a separate member, detachment for washing or exchange upon breakage, etc., can be facilitated.

Also as shown in FIG. 6, bill guide plate 52A and mounting member 52B can be fixed by the single fixing screw BF1 and the integrated bill guide plate 52A and mounting member 52B can be fixed by a single fixing screw BF2 onto control panel 50.

In this embodiment, it was described that the openings of the bill guide plate 52A are slit openings 521 which are open grooves having a bottom formed by an opening bottom part 600 as an example. However, the openings may open through directly below from the bill guide surface 522 side.

The openings of the bill guide plate 52A have grooves on the bill guide surface 522. The openings of the bill guide plate 52A have a passage hole which guides bills foreign matter, or the like thereinto.

With the present invention, the bill guide plate, for guiding a bill to the bill insertion slot, has openings which separate foreign matter of predetermined size and cause such foreign matter to drop. Foreign matter can thus be restrained from getting on the various devices inside the cabinet through the bill insertion slot, even when a drink or other foreign matter spills onto the bill guide plate. And breakage of the various devices can thus be prevented.

Also with the present invention, the partition members, which partition the above-described slit openings into a plurality of regions, are formed on the above-described bill guide plate. Relatively large foreign matter can thus be prevented from falling through the slit openings. Clogging of an internal part due to large foreign matter can thus be prevented.

Furthermore with the present invention, by each opening of the small slit openings, which are partitioned by the above-described partition members, being shorter in length than the diameter of a coin used in the gaming machine. Thus even when a coin used in the gaming machine is dropped onto the bill guide plate by mistake, the coin can be prevented from dropping through the slit openings.

Also with the present invention, the above-described gaming machine is arranged so that a door has a mounting member, which can be mounted in a detachable manner, and the above-mentioned mounting member has a first opening, which is covered by the above-described bill guide plate, and a second opening part, which is connected with the second opening and is opened downwards. The mounting member, which is a part that contacts foreign matter from the exterior, can thus be detached readily from the cabinet, thus enabling detachment for washing or upon breakage, exchange, etc., to be performed readily.

With this embodiment, the slit openings were described as open grooves, each having a bottom at a part thereof, however, the slit openings may instead be complete openings without any bottom over the entirety. The slit openings can be made into complete openings by cutting short the opening bottom parts 600.

Also, with this embodiment, partition members 523 are formed on bill guide plate 52A to partition slit openings 521 so that coins, etc., will not fall through slit openings 521. However, openings of hole formation may instead be in a sieve-like manner in bill guide plate 52A to prevent the dropping of coins.

Also, though two partition members 523 are formed for slit openings 521, this number may be three or more. By increasing the number of partition members, the positioning interval of the partition members can be made small to enable the dropping of smaller objects to be prevented.

What is claimed is:

1. A gaming machine capable of accepting bills, the gaming machine comprising:

a cabinet;

a door provided on a front face of the cabinet of said gaming machine;

a control panel provided in an operating part of the door, the control panel having a notched part;

a bill insertion slot provided in the door; and a bill guide plate provided on the door and extending forward from a lower end of the bill insertion slot for guiding a bill into the bill insertion slot, wherein the bill guide plate has a plurality of openings for dropping foreign matter separated from the bill;

wherein the door has a mounting member;

the mounting member has a first open end covered by the bill guide plate and located under the openings of the bill guide plate for receiving the foreign matter dropped from said openings, and a second open end located below and communicated with the first open end, second open end being opened downwards for directing the foreign matter further downwardly;

the mounting member is located directly below the bill guide plate;

the bill guide plate is mounted as a separate member onto the mounting member;

a protrusion is formed on a rear wall of the bill guide plate and a cylindrical protrusion is formed on a front lower wall of the bill guide plate, the cylindrical protrusion comprising an internal thread; and a groove is formed in a rear inner wall of the first open end of the mounting member, and the protrusion of the bill guide plate is insertable into the groove and the bill guide plate is tiltable towards the mounting member in order to assemble the bill guide plate onto the mounting member.

2. The gaming machine according to claim 1, wherein the plurality of openings are a plurality of slot openings of a substantially rectilinear formation that are disposed parallel to each other.

3. The gaming machine according to claim 2, wherein the bill guide plate further has a plurality of partition members which divide the slot openings into smaller slit openings.

4. The gaming machine according to claim 3, wherein a length of each of the smaller slit openings formed by the partition members is smaller than a diameter of a coin utilized with the gaming machine.

5. The gaming machine according to claim 3, wherein upper surfaces of the partition members are below a top surface of the bill guide plate.

6. A gaming machine according to claim 1, wherein the mounting member and the bill guide plate fixed thereto are inserted into the notched part of the control panel.

7. The gaming machine according to claim 6, wherein the bill guide plate is fixed to the mounting member by a single fixing screw threadedly engaged with the internal thread of said cylindrical protrusion.

8. The gaming machine according to claim 6, wherein the plurality of openings are a plurality of slot openings of a substantially rectilinear formation that are disposed parallel to each other.

9. The gaming machine according to claim 8, wherein the bill guide plate further has a plurality of partition members which divide the slot openings into smaller slit openings.

10. The gaming machine according to claim 9, wherein a length of each of the smaller slit openings formed by the partition members is smaller than a diameter of a coin utilized with the gaming machine.

11. The gaming machine according to claim 9, wherein upper surfaces of the partition members are below a top surface of the bill guide plate.

12. The gaming machine according to claim 6, wherein the mounting member has a passage extending downward from the first open end to the second open end, being tapered as the passage extends downwardly.

13. The gaming machine according to claim 6, further comprising a bill validator housed in the cabinet for receiving and validating bills inserted though the bill insertion slot;

wherein a top surface of the bill guide plate is open to the outside through an loading slot on the door.

14. The gaming machine according to claim 13, wherein an entirety of the top surface of the bill guide plate is accessible from the outside through said loading slot.

15. The gaming machine according to claim 14, wherein an entirety of the bill guide plate is insertable through said loading slot to allow the bill guide plate to be installed or removed though said loading slot.

16. The gaming machine according to claim 1, wherein the mounting member has a passage extending downward from the first open end to the second open end, being tapered as the passage extends downwardly.

17. The gaming machine according to claim 1, wherein the bill guide plate is fixed to the mounting member by a single fixing screw threadedly engaged with the internal thread of said cylindrical protrusion.

18. The gaming machine according to claim 1, further comprising a bill validator housed in the cabinet for receiving and validating bills inserted though the bill insertion slot;

wherein a top surface of the bill guide plate is open to the outside through a loading slot of the notched part.

19. The gaming machine according to claim 18, wherein an entirety of the top surface of the bill guide plate is accessible from the outside through said loading slot.

20. The gaming machine according to claim 19, wherein an entirety of the bill guide plate is insertable through said loading slot to allow the bill guide plate to be installed or removed though said loading slot.

* * * * *